US005659287A

United States Patent [19]

Donati et al.

[11] Patent Number: 5,659,287

[45] Date of Patent: Aug. 19, 1997

[54] STROBE SYNCHRONIZATION FOR AVERTING CONVULSIVE REACTIONS TO STROBE LIGHT

[75] Inventors: Richard Joseph Donati, Bristol, Conn.; John Finley Zeigler, III, Canton, Ohio

[73] Assignee: General Signal Corporation, Stamford, Conn.

[21] Appl. No.: 408,021

[22] Filed: Mar. 21, 1995

(Under 37 CFR 1.47)

[51] Int. Cl.[6] ..... G08B 5/00

[52] U.S. Cl. ..... 340/331; 340/472; 340/474; 315/292; 315/294

[58] Field of Search ..... 340/331, 472, 340/474, 628, 384; 315/324, 316, 292, 294

[56] References Cited

U.S. PATENT DOCUMENTS

| | | | |
|---|---|---|---|
| 4,189,709 | 2/1980 | Gosswiller | 340/472 |
| 4,595,904 | 6/1986 | Gosswiller | 340/472 |
| 4,935,951 | 6/1990 | Robinson et al. | 379/37 |
| 4,952,906 | 8/1990 | Buyak et al. | 340/331 |
| 5,019,805 | 5/1991 | Curl et al. | 340/628 |
| 5,034,662 | 7/1991 | Nishida et al. | 315/241 P |
| 5,041,767 | 8/1991 | Doroftei et al. | 315/292 |
| 5,097,397 | 3/1992 | Stanuch et al. | 340/472 |
| 5,128,591 | 7/1992 | Bocan | 315/241 S |
| 5,296,840 | 3/1994 | Gieffers | 340/474 |
| 5,341,069 | 8/1994 | Kosich et al. | 315/241 S |
| 5,422,623 | 6/1995 | Bader et al. | 340/472 |

*Primary Examiner*—Jeffery Hofsass
*Assistant Examiner*—Davetta Woods
*Attorney, Agent, or Firm*—Ohlandt, Greeley, Ruggiero & Perle

[57] ABSTRACT

There is provided a synchronous strobe system for synchronizing a flash rate of a plurality of strobe devices positioned along a loop of an alarm system. After the alarm system is energized and activated, a control panel of the synchronous strobe system will transmit a synchronization signal or pulse along the loop at periodic time intervals. Each synchronization signal is detected by a electronic circuit of the strobe device, including a microcontroller. Upon detection of each synchronization signal, the microcontroller determines whether to operate the strobe device in Sync required mode or Sync not required mode. For Sync required mode, the synchronization signal must be detected by the strobe device to flash a strobe light of the strobe device. Otherwise, the microcontroller waits for the next synchronization signal before attempting to flash the strobe light. For the Sync not required mode, the strobe light is flashed at an independent flash rate until the synchronization signal is detected and used to realign the flash rate. By flashing the strobe devices in response to the synchronizing signal, the composite flash rate of the strobes can be controlled and synchronized in an efficient manner to avert a composite flash rate that could trigger a convulsive reaction, such as an epileptic seizure.

15 Claims, 7 Drawing Sheets

STROBE SYNCHRONIZATION FOR AVERTING CONVULSIVE REACTIONS TO STROBE LIGHT

BACKGROUND OF THE INVENTION

I. Field of the Invention

The present invention relates generally to electronic alarm systems for controlling a plurality of strobe devices connected to an alarm control panel. More particularly, the present invention relates to an electronic alarm system having one or more loops of strobe devices whereby all of the strobe devices along a single loop operate to flash in sync.

Strobe devices that emit light are typically used in alarm systems, such as fire alarm systems, to visually alert people in a protected area of an emergency situation. Such alarm systems may also include other types of notification appliances, such as an audible signaling appliance or horn. Ideally, strobe devices are situated throughout an entire building to ensure proper protection of all areas. Thus, any person in the building would be in viewing range of at least one strobe device.

In order to ensure proper coverage, it is quite common to have more than one strobe device in a single viewing area. For prior art strobe designs, the timing for flashing the strobe light is controlled by each individual device. Since each strobe device runs independently, it would be common for two or more devices to flash out of sync or sequence with respect to each other. Even when devices initially flash in sync, the flash interval for the devices may slowly drift apart after a certain period of time, resulting in a flash followed by another flash shortly thereafter.

A problem that occurs with having two or more non-synchronized strobe devices within a single viewing range is that a photoconvulsive response may be triggered in individuals having photosensitive conditions. In particular, a person suffering from epilepsy may have a seizure by viewing a high frequency of light flashes. Although the flash rate of a single device can be controlled, the composite flash rate of a plurality of non-synchronized devices could produce a high frequency of light flashes and potentially trigger a convulsive reaction. Underwriters Laboratory has stated that epileptic seizures are not necessarily instituted by multiple flashes alone, but are more directly caused by any two flashes within 0.2 seconds. Likewise, the United States Department of Transportation, in view of the Americans with Disabilities Act Accessibility Guidelines, has taken a similar position and further stated that two or more non-synchronized devices within a single viewing area than can produce a composite flash rate that could trigger an epileptic seizure.

II. Description of the Prior Art

Strobe devices that produce a light flash at a set frequency are known. For example, U.S. Pat. No. 4,952,906 to W. P. Buyak, et al. titled STROBE ALARM CIRCUIT provides a strobe light circuit for flashing a strobe flash unit at a desired frequency, even when changes in its supply voltage occur. For this strobe light circuit, a switch controls the charging of a inductor by a power source and the discharging of the inductor to a capacitor and flash unit combination. The switch is opened when the inductor current reaches a predetermined value, and the switch is closed in response to a timing signal having a regular period. The frequency does not vary since the same amount of energy is stored in the inductor for each cycle of the switch.

It is also known that microcontrollers may be used to control the flash rate of a light signal device. For example, U.S. Pat. No. 4,935,951 to G. J. Robinson, et al., which issued on Jun. 19, 1990, provides an emergency telephone actuated signal light having a microcontroller for comparing the dialed numbers with a stored emergency number. Also, U.S. Pat. No. 5,341,069 to J. Kosich, et al., which issued on Aug. 23, 1994, provides a strobe light circuit having a microcontroller for triggering a flashtube at a predetermined rate.

However, none of the above U.S. patents provide any way of synchronizing a plurality of strobe devices in order to avert a composite flash rate that could trigger a convulsive reaction, such as an epileptic seizure. Thus, there is a need for a system for synchronizing a plurality of strobe devices so that they flash in sync with each other, especially synchronizing two or more devices within the same viewing area. Such a system should avert a situation where an individual, particularly a person susceptible to photoconvulsive reactions, would view more than one light flash within a short period of time and have a convulsive reaction.

Against the foregoing background, it is a primary object of the present invention to provide a synchronous strobe system of an alarm system that synchronizes a plurality of strobe devices so that the strobe light of all strobe devices flash at the same time.

It is another object of the present invention to provide such a synchronous strobe system in which a synchronization signal is transmitted throughout the strobe loop to provide the strobe devices with a reference signal to synchronize all of their flashes.

It is a further object of the present invention to provide such a synchronous strobe system in which each of the strobe devices has electronic circuitry, including a microcontroller, to detect the synchronization signal and flash the strobe light based on the signal.

It is still further object of the present invention to provide such a synchronous strobe system in which each of the strobe devices may operate in a Sync required mode or Sync not required mode. For Sync required mode, the synchronization signal must be detected by the strobe device to flash a strobe light of the strobe device. Otherwise, the microcontroller waits for the next synchronization signal before attempting to flash the strobe light. For Sync not required mode, the strobe light is flashed at an independent flash rate until the synchronization signal is detected and used to realign the flash rate.

SUMMARY OF THE INVENTION

To accomplish the foregoing objects and advantages, the present invention, in brief summary, comprises a control panel, having means for generating a synchronization signal on a periodic time basis; means for transmitting the synchronization signal from the control panel, the transmitting means being electrically connected to the control panel; and a plurality of strobe devices electrically connected to the transmitting means for receiving the synchronization signal. Each of the strobe devices comprises means for detecting the synchronization signal transmitted along the transmitting means and means, responsive to the detection of the synchronization signal, for flashing a strobe light, wherein the strobe lights of the plurality of strobe devices flash together in sync with each other.

More specifically, a feature of the present invention is a strobe device that comprises means for detecting the synchronization signal transmitted by the control panel; a microcontroller, responsive to detection of the synchronization signal by the detection means, for producing a strobe output signal; and means, responsive to the strobe output signal of the microcontroller, for flashing a strobe light, wherein the strobe lights of the plurality of strobe devices flash together in sync with each other.

BRIEF DESCRIPTION OF THE DRAWINGS

The foregoing and still further the objects and advantages of the present invention will be more apparent from the following detailed explanation of the preferred embodiments of the invention in connection with the accompanying drawings.

DETAILED DESCRIPTION OF THE PREFERRED EMBODIMENT

Figure 1:
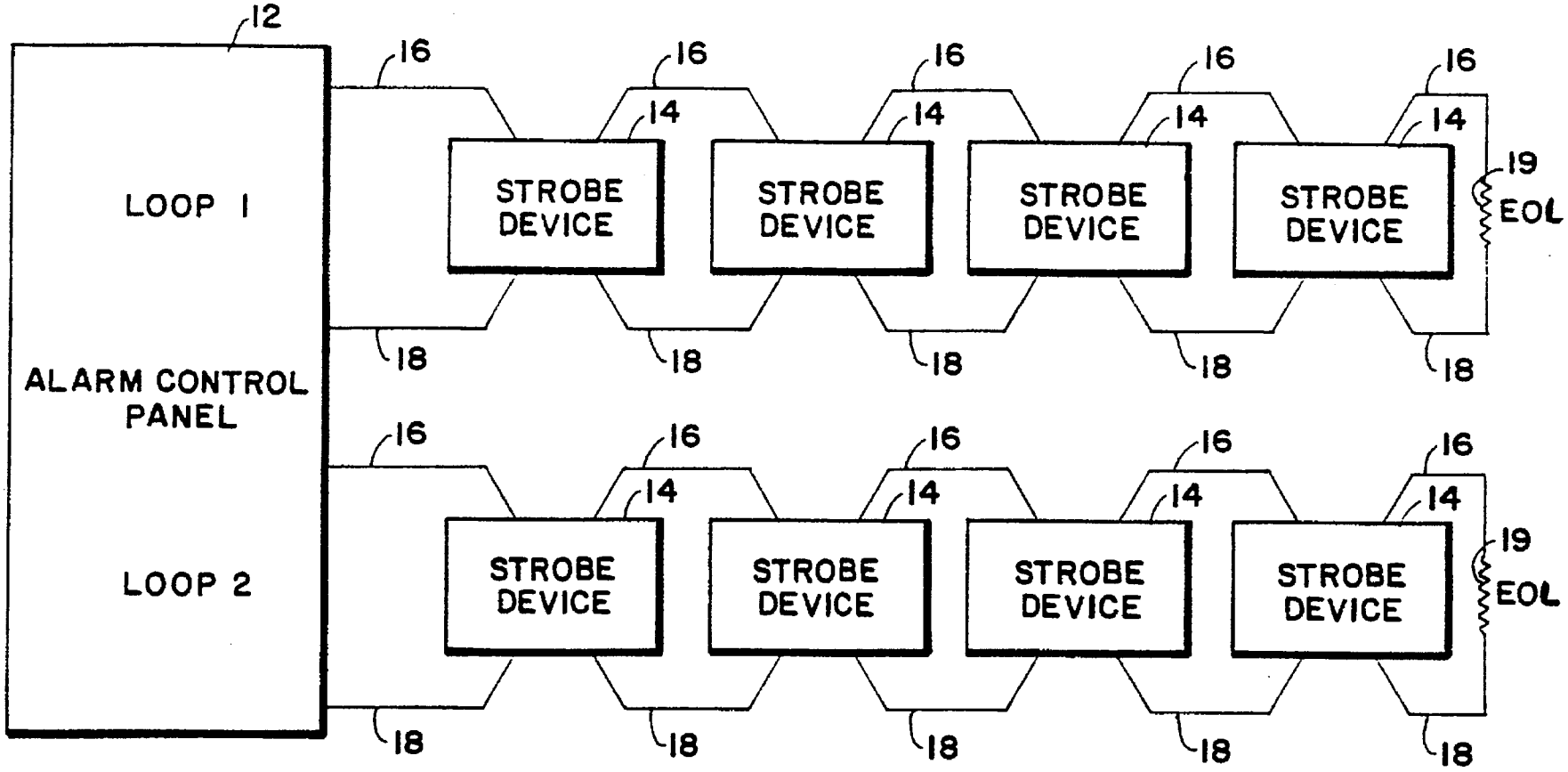
FIG. 1 is a block diagram of the alarm system of the preferred embodiment of the present invention.

Referring to the drawings and, in particular, to FIG. 1, there is provided a synchronous strobe scheme for an alarm system of the preferred embodiment which is generally represented by reference numeral 10. The strobe scheme 10 comprises an alarm control panel 12 and one or more loops of strobe devices 14 connected in parallel between electrical lines 16, 18 that extend from the alarm control panel to an end-of-line or termination point 19. Two loops of strobe devices 14 are shown in FIGS. 1. The lines 16, 18 may also connect to other appliances (not shown) of the alarm system, such as an audible signaling appliance. Through the lines 16, 18, the alarm control panel 12 communicates to the strobe devices 14 that one of two conditions exist: an alarm condition and a non-alarm condition.

Through these same lines 16, 18, the alarm control panel 12 is also capable of sending a synchronization signal or sync pulse to the strobe devices 14 during an alarm condition. Preferably, the sync pulse is transmitted at time intervals of up to 10 minutes, including time intervals of one minute or less. The alarm control panel 12 responds to an indication of an alarm condition by controlling the strobe operation of the strobe devices 14. To control the strobes' synchronizing operation, the alarm control panel 12 sends a synchronization signal or sync pulse to all the strobe devices 14 connected along the electrical lines 16, 18. The electronic control circuits of each strobe device 14 sense a valid sync pulse and flashes a strobe light signal accordingly.

Alternatively, the synchronization operation of the strobe devices 14 may be controlled by the alarm control panel 12 based on feedback signals generated by the strobe devices. This feedback based synchronization operation may be used in a situation where the flash rate of the strobe light is based on the detection of the sync pulse. Each of the strobe devices 14 transmits a current pulse along the electrical lines 16, 18 that corresponds to the firing time of the strobe light. While all of the strobe devices 14 are in synchronization, their current pulses, as sensed by the alarm control panel 12, are superimposed. However, as the strobe devices 14 begin to drift out-of-sync, the alarm control panel 12 will detect multiple current pulses where a single superimposed current pulse is expected. When the alarm control panel 12 senses these multiple current pulses, it will generate and transmit a sync pulse along lines 16 and 18 to pull the strobe devices 14 back into synchronization. Preferably, the alarm control panel 12 would sense multiple current pulses and when the current pulses sensed by the control panel 12 from the strobe devices 14 drift apart beyond 150 milliseconds, a sync pulse will be generated. This threshold for generating the sync pulse can be out as much as 200 milliseconds to conform with the requirements of the Americans with Disabilities Act.

Each pair of electrical lines comprises an upper line 16 and lower line 18. Under non-alarm conditions, the upper line 16 is negative with respect to the lower line 18. By monitoring the lines 16, 18 during the non-alarm condition, the alarm control panel 12 supervises the lines for any breaks. When an alarm condition occurs, such as the existence of fire and/or smoke, the alarm control panel 12 will reverse the polarity of the lines so that the upper line 16 is positive with respect to the lower line 18. This change in polarity of the lines 16, 18 activates the alarm condition for each strobe device 14 connected long the lines.

During the alarm condition, the alarm control panel 12 transmits periodically a synchronization signal or sync pulse to the strobe devices 14 via the upper line 16 and the lower line 18. As stated above, under alarm conditions, the upper line 16 is positive with respect to the lower line 18. To send the sync pulse, the polarity of the lines are reversed for a brief period of time so that the upper line 16 is negative with respect to the lower line 18 for a predetermined pulse period. For the preferred embodiment, the predetermined pulse period is about 14 milliseconds.

The preferred embodiment of the present invention utilizes the electrical lines 16, 18 not only to supply electrical power from the alarm control panel 12 to the strobe units 14 but also transmit a sync pulse as well, as described above. By using the lines 16, 18 to power the strobe devices and transmit the sync pulse, the preferred embodiment may be manufactured and installed economically. However, it is to be understood that the present invention is designed to utilize any type of signal transmitting means to send a synchronization signal or sync pulse from the alarm control panel 12 to the strobe devices 14. For example, such signal transmitting means 99 may take other forms such as a separate electrical signal transmitting line, light signal transmission, or RF signal transmission, as shown in FIG. 2.

Figure 2:
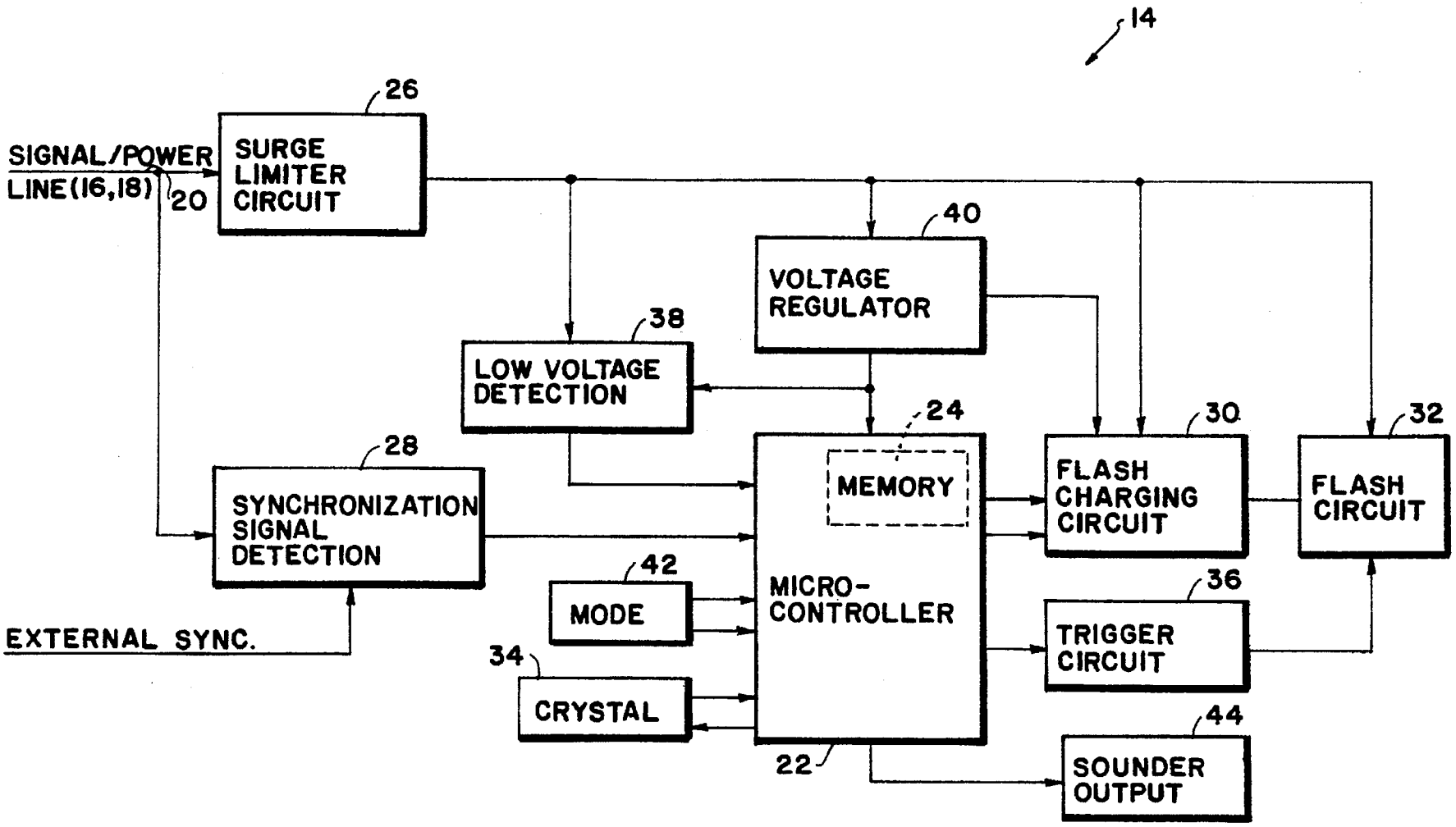
FIG. 2 is a block diagram of the strobe device of the preferred embodiment, shown in FIG. 1.

A block diagram of hardware configuration of a single strobe device 14 is generally shown in FIG. 2. As described above, any type of signal transmitting means may be used by the strobe device 14 to receive the sync pulse. Thus, the input line 20 of the strobe device 14 of FIG. 2 corresponds to the electrical lines 16, 18 of FIG. 1.

Figure 3:
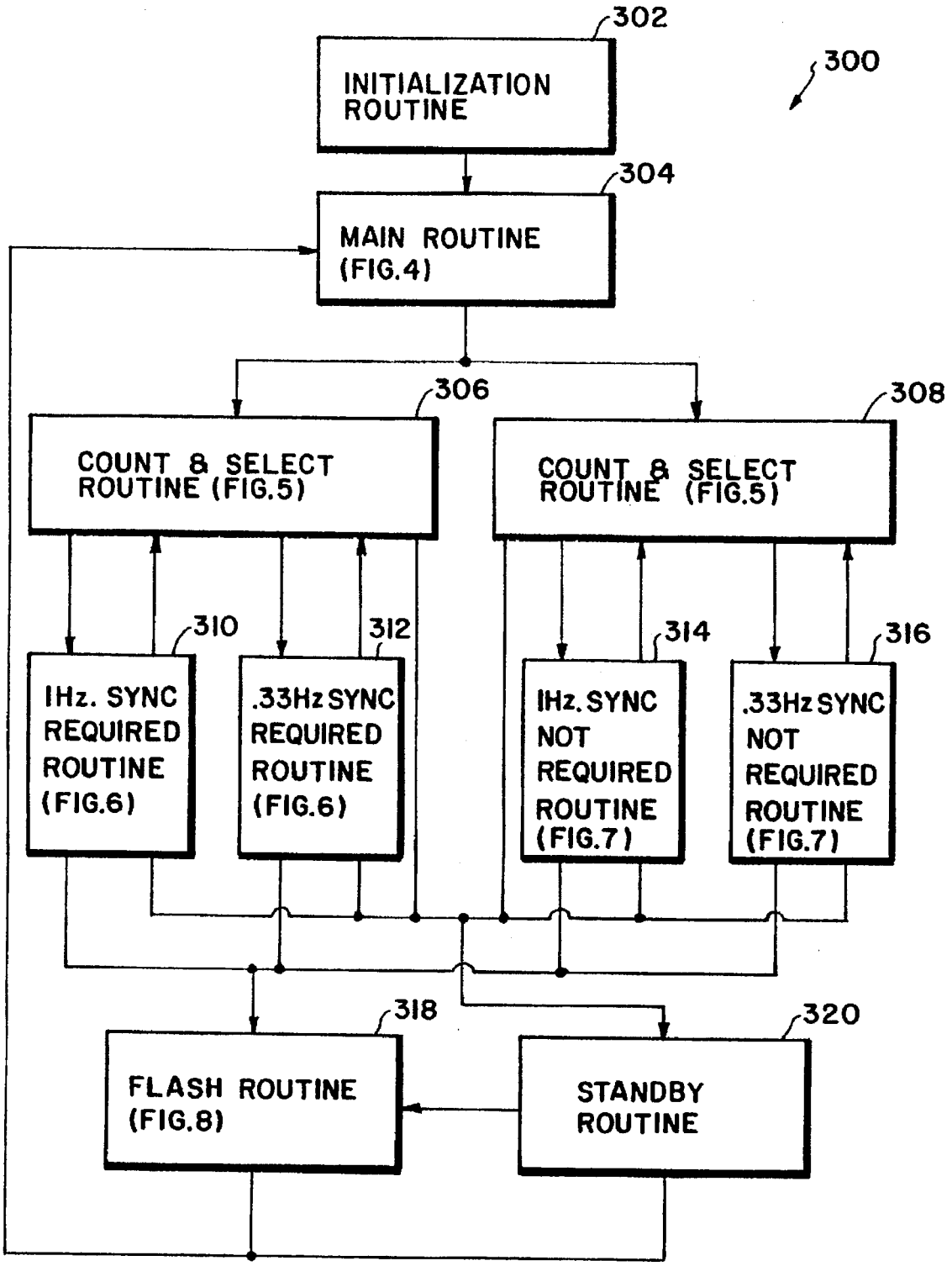
FIG. 3 is a general flow diagram of the routines executed by the microcontroller of the strobe device of FIG. 2.

Referring to FIG. 2, the general layout of each strobe device 14 includes a microcontroller 22. For the preferred embodiment, the microcontroller 22 has a programmable memory portion 24 that stores software or firmware instructions 300 (FIG. 3). These instructions or program routines 300 are stored within the memory portion 24 as described below in reference to FIGS. 3 through 14. Although such a programmable microcontroller 22 is preferred, the instructions 300 may be stored external to the microcontroller 22, such as an EPROM circuit or chip connected thereto.

The synchronization signal detection circuit 28 detects all of the sync pulses that are sensed by the strobe device 14 and sends a corresponding detection signal to the microcontroller 22. Upon sensing the sync pulse from the alarm control panel 12, the microcontroller 22 determines if enough energy has been stored by the flash circuit 32 to flash a strobe light at an adequate flash intensity. This determination is made by checking the number of energy units that have been supplied by the flash charging circuit 30, as controlled by the microcontroller 22. The microcontroller 22 generates a pulse stream which controls the rate of transfer of energy from the flash charging circuit 30 to the flash circuit 32. The microcontroller 22 also generates the firing pulse to control the particular flash rate of the flash circuit 32. For the preferred embodiment, this specified flash rate is either 1 Hz. or 0.33 Hz. and is based on the frequency of a crystal controlled oscillator 34 connected to the microcontroller 22. If a sufficient number of energy units have been stored by the flash circuit 32, the microcontroller 22 instructs a trigger circuit 36 to send a trigger signal to the flash circuit and causes the flash circuit to discharge or flash. If the microcontroller 22 determines that a sufficient number of energy units have not been delivered to the flash circuit 32 to support an adequate flash intensity, then microcontroller 22 instructs the flash charging circuit 30 to continue transferring energy and waits for the next sync pulse.

Another operation of the strobe device 14 is to monitor the internal circuit voltage and determine if sufficient voltage is present for normal circuit operation. This is done by the low voltage detection circuit 38 by comparing the voltage from the surge limiter circuit 26 to a reference voltage. If the line voltage is below the reference voltage, the low voltage detection circuit 38 sends a low voltage detection signal to the microcontroller 22. Then, the microcontroller 22 will delay circuit operation until the proper voltage level for the strobe device 14 is again reached. One advantage of this operation is to prevent excessive power consumption on the alarm control panel 12 during power-up of the strobe device 14.

A mode circuit 42 and a sounder output port 44 are also connected to the microcontroller 22. The mode circuit 42 places the microcontroller 22 in one of two modes: a Sync required mode or a Sync not required mode. For Sync required mode, the sync pulse must be detected by the strobe device 14 to flash the strobe light of the flash circuit 32. On the other hand, for the Sync not required mode or free running mode, the microcontroller 22 flashes the strobe light of the flash circuit 32 at an preset flash rate until a sync pulse is detected, the sync pulse being utilized to realign the flash rate with the sync pulse. The sound output port 44 provides a variety of audible signals in conjunction with the flashes of the strobe light during an alarm condition. For example, the microcontroller 22 may instruct the sounder output port 44 to provide a constant 44 Hz. signal, a three pulse tone signal, or a three pulse tone with a 10% or 50% duty cycle of the 44 Hz. signal.

Referring to FIG. 3, the microcontroller executes a series of program routines 300 that are represented in more detail by FIGS. 4 through 9. For the preferred embodiment, these routines 300 are internally programmed into the memory portion of the microcontroller. When the strobe device 14 is initially supplied with power, the initialization routine 302 is first executed. During the initialization routine all variables and registers are set to their initial values and all counters are reset. Once the initialization routine is complete, a main routine 304 of the microcontroller's program routines 300 is executed. Then, the microcontroller 22 executes one of the two count and select routines 306, 308. Next, the microcontroller 22 executes one of the Sync required routines 310, 312 or Sync not require routines 314, 316, depending upon which count and select routine 306, 308 was just previously executed. Each Sync required routine 310, 312 and Sync not required routine 314, 316 may be executed for a 1 Hz. flash rate or 0.33 Hz. flash rate of the flash circuit 32. Finally, the flash routine 318 is executed, and control of the microcontroller 22 returns to the main routine 304. In addition, the microcontroller may go in standby mode, via the standby routine 320, throughout the operation of the microcontroller 22.

Figure 4:
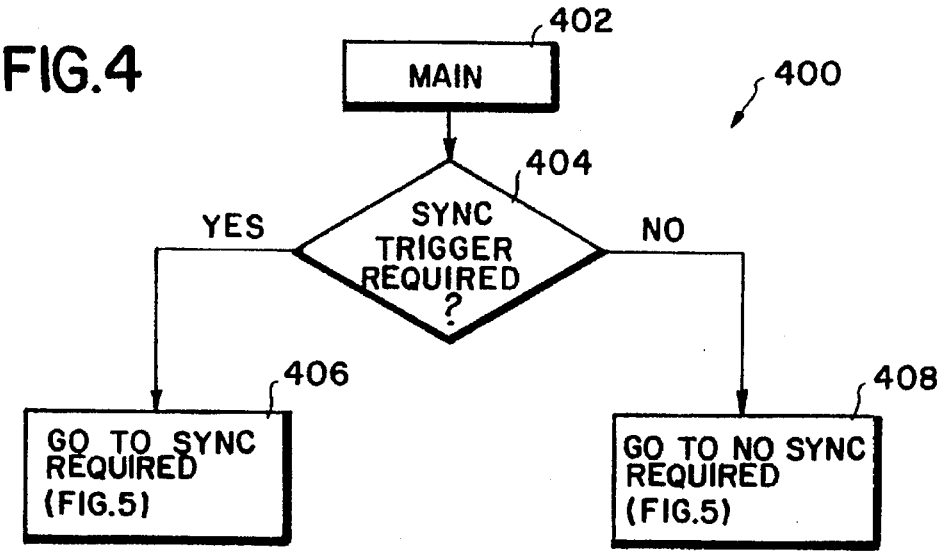
FIG. 4 is a flow diagram of the main program routine shown in FIG. 3 for determining whether to operate the microcontroller in Sync mode or No Sync mode.

Referring to FIG. 4, the main routine is executed, starting with step 402, upon completion of the initialization routine. For the main routine, the microcontroller 22 simply determines whether to operate in Sync required mode or Sync not required mode 404. In Sync required mode 406, the strobe device 14 will flash a strobe light only when the sync pulse is detected. In B contrast, for Sync not required mode or free running mode 408, the strobe device 14 will operate at a 1 or 0.33 Hz. flash rate while concurrently monitoring the input line 20 for the presence of the sync pulse. If the sync pulse is detected during the Sync not required mode, the strobe device 14 realigns the flash rate to correspond with the sync pulse.

The determination of whether to choose the Sync required mode or Sync not required mode is made by the microcontroller 22 based on the information received from the mode circuit 42, shown in FIG. 2. After determining the mode in which to operate, the operation of the microcontroller 22 subsequently proceeds to the count and select routine 306 for the Sync required routine or the count and select routine 308 for the Sync not required routine, as appropriate.

Figure 5:
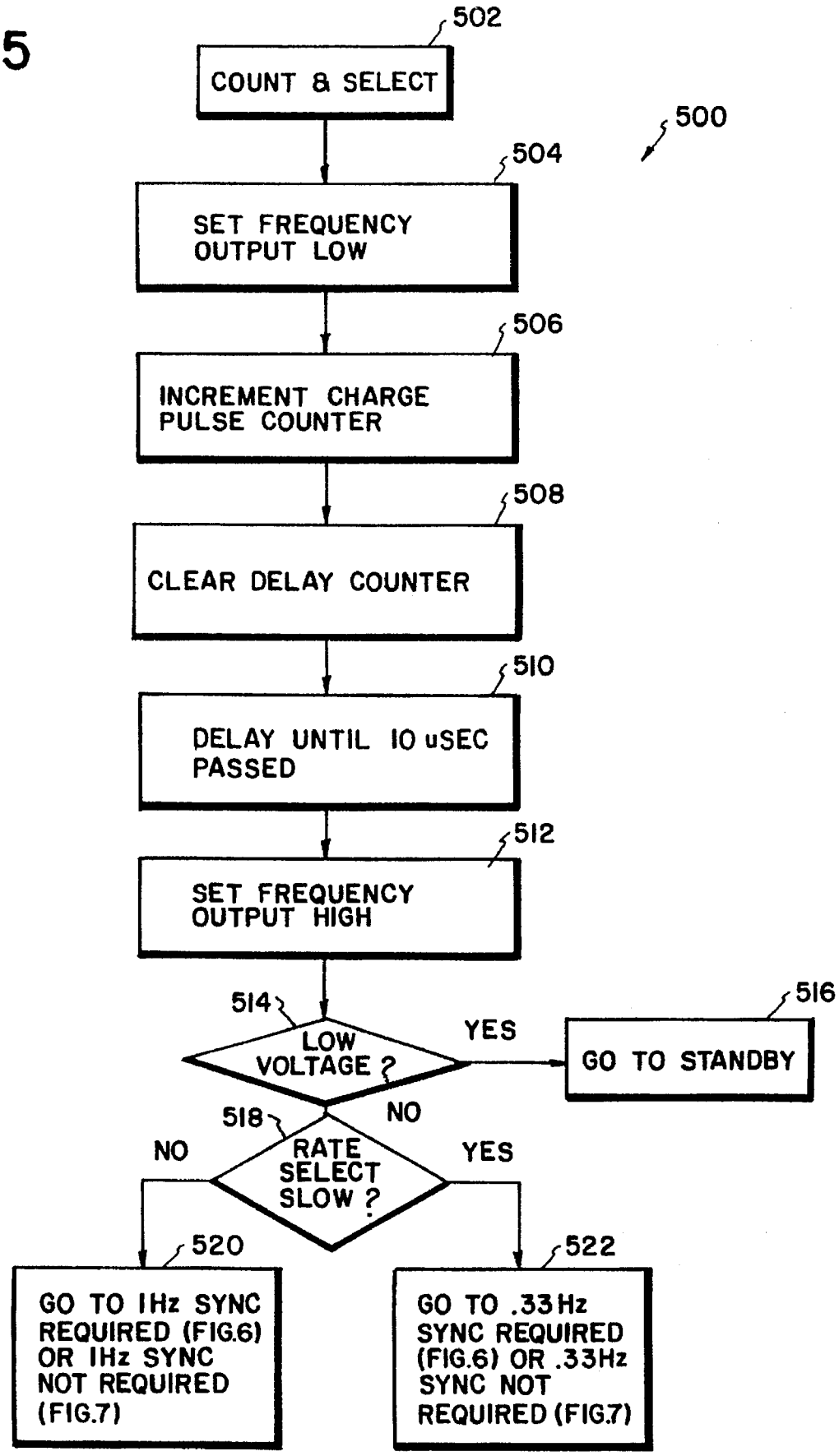
FIG. 5 is a flow diagram of the count and select routines shown in FIG. 3 for counting the charging rate of the energy stored for the strobe light and determining the frequency, i.e., 1 Hz. or 0.33 Hz., of the flash rate for Sync mode.

Referring to FIG. 5, a general count and select routine 500 is shown. As shown in the flow diagram of FIG. 3, the program routines 300 of the preferred embodiment utilize separate count and select routines 306, 308 for the Sync required mode and the Sync not required mode. However, since both count and select routines are similar, only one general count and select routine 500 is provided in the present application to represent either of the two count and select routines 306, 308 shown in FIG. 3.

The count and select routine 500 controls the charging rate of the energy stored for the strobe light of the flash circuit 32 and determines the frequency of the flash rate of the strobe light. The microcontroller 22 controls the charging rate for the strobe light by supplying a constant stream of pulses to the flash charging circuit 30. Starting at step 502, a pulse unit is generated by setting the frequency output to low 504, delaying 510 the microcontroller 22 based on a delay counter 508, and then reverting the frequency output back to high 512. For the preferred embodiment, the intermediate delay of the generation of the pulse is 10 microseconds, as indicated in step 510. Also, a charge pulse counter is incremented 506 during the generation of the charge pulse to keep track of the number of charge pulses stored for the strobe light.

After the pulse unit is generated, the microcontroller 22 checks the regulated circuit voltage of the strobe device 14. If the circuit voltage falls below a predetermined threshold value 514, the microcontroller 22 will go to a standby procedure 516. For the preferred embodiment, the predetermined threshold value is 15 volts DC.

As long as the circuit voltage is at or above the predetermined threshold value, the initial Sync mode routine will continue and the microcontroller will determine the flash rate of the strobe light 518. The flash rate determination 518 is made by the microcontroller 22 based on a user initiated action. For example, the user may pre-program the microcontroller 22 before activation of the strobe device 14 or send a mode-specific signal to the microcontroller 22 during operation of the strobe device from an external source, such as the alarm control panel 12 shown in FIG. 1 or mode circuit 42 shown in FIG. 2. Upon determination of the flash rate, the microcontroller 22 jumps to the 1 Hz. Sync routine 520 or 0.33 Hz. Sync routine 522.

Referring to FIGS. 3 and 5 together, at step 520, the microcontroller 22 will jumps to the 1 Hz. Sync required routine 310 if the sync required mode was previously selected, or the 1 Hz. Sync not required routine 314 if the sync not required mode was selected, in the main routine 304. Similarly, at step 522, the microcontroller 22 will jump to the 0.33 Hz. Sync required routine 312 if the sync required mode was previously selected, or the 0.33 Hz. Sync not required routine 316 if the sync not required mode was selected, in the main routine 304.

Figure 6:
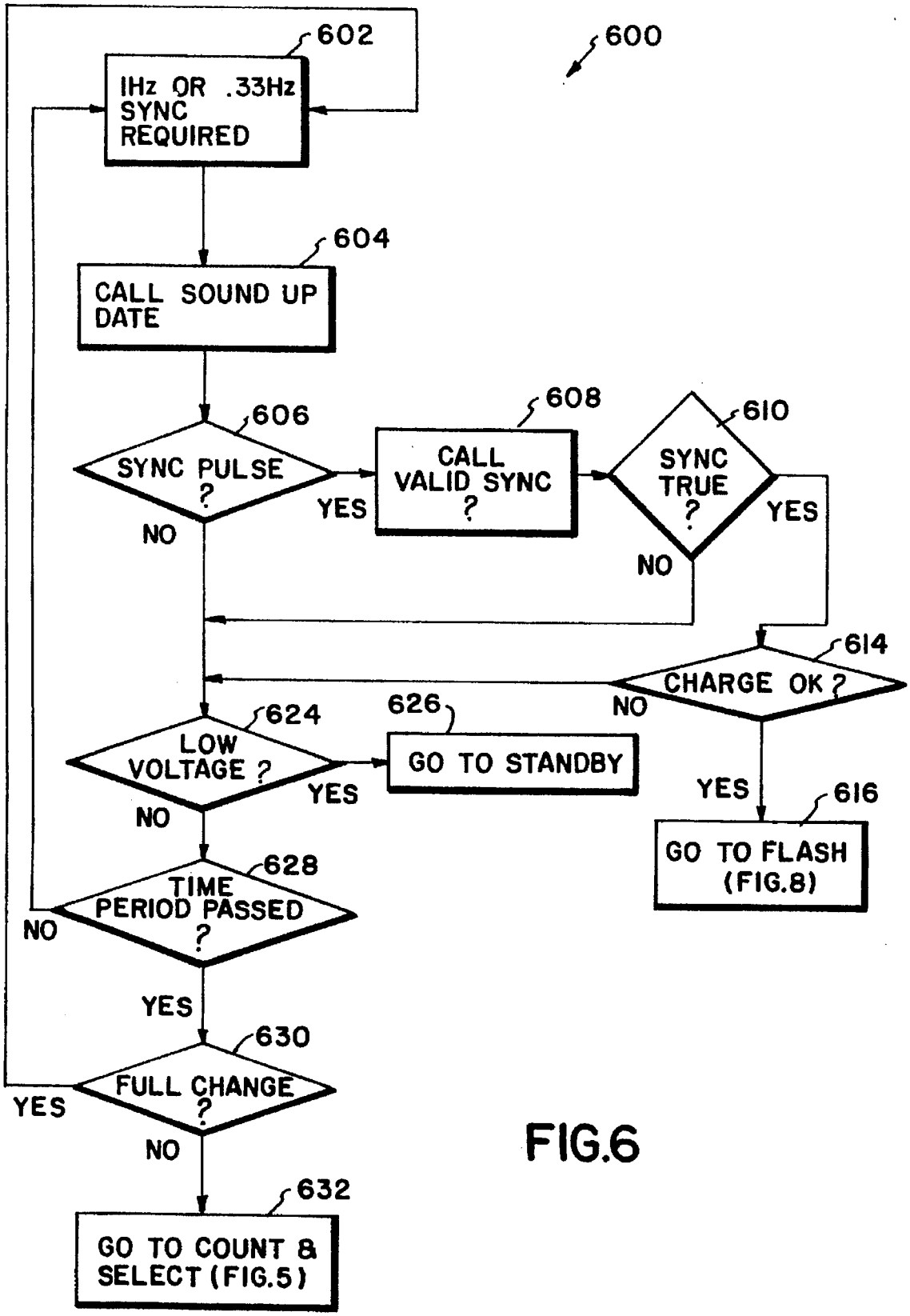
FIG. 6 is a flow diagram of the Sync required routines shown in FIG. 3 in which a synchronization signal must be detected by the strobe device to flash a strobe light of the flash circuit at either 1 Hz. or 0.33 Hz.

Referring to FIG. 6, a general sync required routine 600 is shown. Since the 1 Hz. Sync required routine 310 and 0.33 Hz. Sync required routine 312 shown in FIG. 3 are similar, the general sync required routine 600 shown in FIG. 6 is presented to represent both of these routines.

For the Sync required routine 600, the sync pulse must be detected by the strobe device 14 in order to flash the strobe light of the flash circuit 32 at a predetermined flash rate, i.e., 1 Hz. or 0.33 Hz. The Sync required routine 600 begins at step 602 and then calls a sound routine 604 upon its activation. During sound routine 604, the microcontroller accesses the sounder output port 44 to provide an audible sound during the Sync required routine 600.

After calling the sound routine 604, a determination is made in step 606 whether a sync pulse has been detected by the synchronization signal detection circuit 28 of the strobe device 14. If the synchronization signal detection circuit 28 indicates to the microcontroller 22 that a sync pulse has been detected, then the microcontroller makes a determination as to whether the sync pulse is valid 608. For the valid sync determination of step 608, the microcontroller 22 examines whether the sync pulse was too low or outside of the range of a valid sync time and reports the results of this examination in step 610. Further, in step 614, the microcontroller 22 determines whether a sufficient charge has been stored by the flash charging circuit 30 to activate the strobe light of the flash circuit 32 at an adequate intensity level. If it is found that the sync pulse is true and has sufficient charge available, the microcontroller 22 will jump to the flash routine of FIG. 8 and activate the strobe light of the flash circuit 32, as indicated by step 616. Otherwise, the strobe light does not flash.

In situations where no sync pulse is detected, the sync pulse is not true, or the charge level for the strobe light is not sufficient, a low voltage determination is made, as shown in step 624. If a low voltage condition is indicated by the low voltage detection circuit 38, the operation of the microcontroller 22 will go into standby mode and proceed to the standby routine 320 of FIG. 3, as indicated by step 626. Thereafter, if a particular time period has passed 628 and a full charge is not available for the strobe light 630, the operation of the microcontroller 22 will return to the count and select routine 500 of FIG. 5, as shown in step 632. Otherwise, operation loops back to the starting step 602 of the Sync required routine 600.

As described above, the 1 Hz. Sync required routine 310 and 0.33 Hz. Sync required routine 312 shown in FIG. 3 are represented by the general sync required routine 600 shown in FIG. 6. Thus, the predetermined time period of step 628 is variable, depending upon the particular routine referenced. In particular, the 1 Hz. Sync required routine 310 preferably has a time period of 64 microseconds whereas the 0.33 Hz. Sync required routine 312 has a time period of 212 microseconds in step 628.

Figure 7:
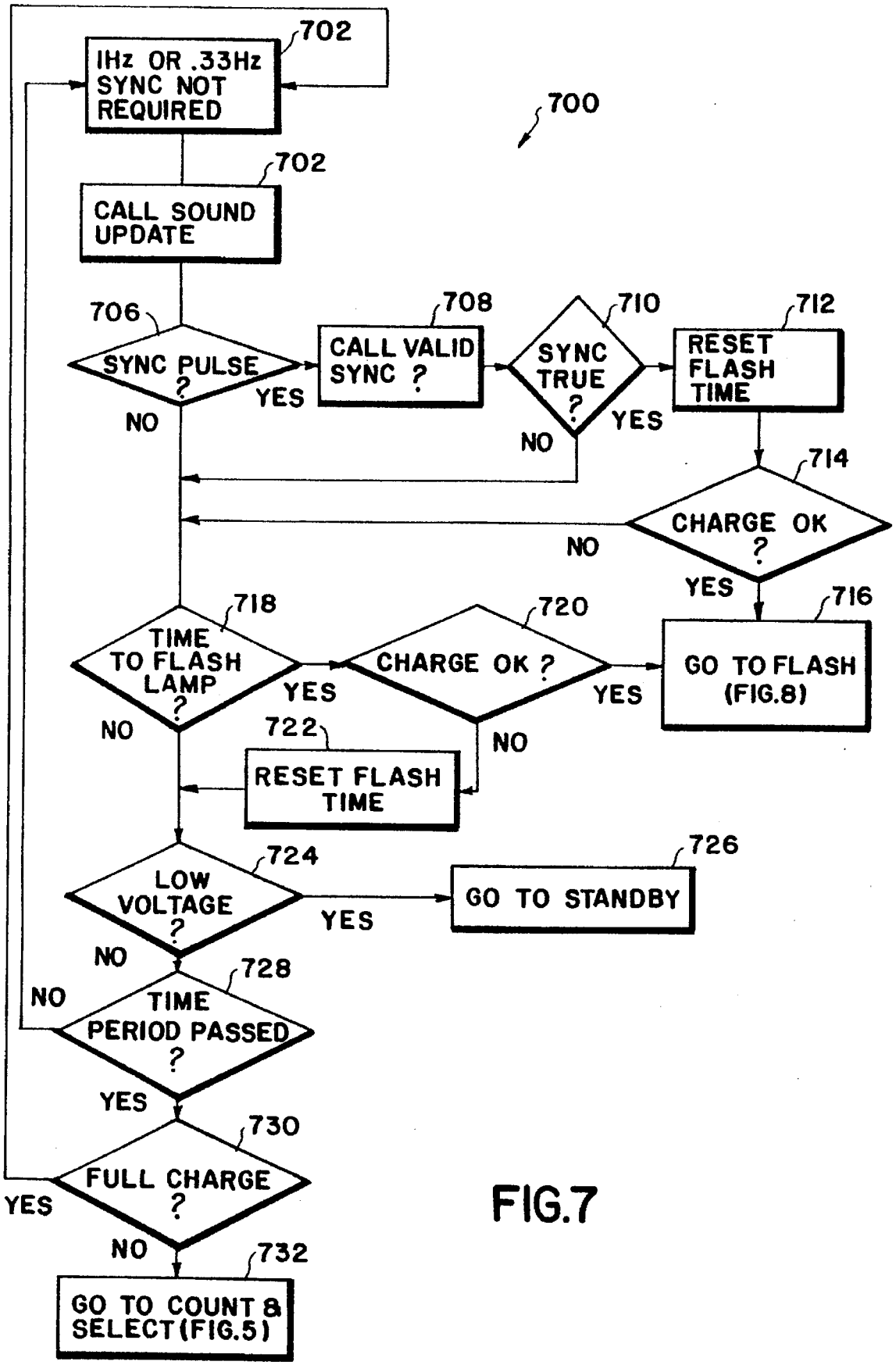
FIG. 7 is a flow diagram of the Sync not required routines shown in FIG. 3 in which the microcontroller flashes the strobe light of the flash circuit at an independent flash rate until a synchronization signal is detected and utilized to realign the 1 Hz. or 0.33 Hz. flash rate in sync with the synchronization signal.

Referring to FIG. 7, a general sync not required routine 700 is shown. Since the 1 Hz. Sync not required routine 314 and 0.33 Hz. Sync not required routine 316 shown in FIG. 3 are similar, the general sync required routine 700 is presented to represent both routines. In fact, similar to the above general sync required routine 600, the only significant difference is that, in step 728, the 1 Hz. Sync not required routine 314 preferably has a time period of 64 microseconds whereas the 0.33 Hz. Sync not required routine 316 has a time period of 212 microseconds.

The operation of the microcontroller 22 during the Sync not required routine 700 is similar to the operation during the Sync required routine 600. In fact, all of the steps of the Sync required routine 600 are also used in the Sync not required routine 700. For those coexisting steps, their operations are the same and, thus, reference will be made only to those steps in the Sync not required routine 700 that are not described for the Sync required routine 600.

The steps unique to the Sync not required routine are steps 712, 718, 720 and 722. In step 710, the microcontroller 22 resets an independent flash rate counter of the strobe device 14 when a valid and true sync pulse is detected. For step 718, the microcontroller 22 determines whether it is time to flash the strobe light based on the independent flash rate counter of the strobe device 14. If it is time to flash and the charge available to the strobe light is adequate, as determined in step 720, operation of the microcontroller 22 continues to the flash routine 800 in step 716. However, if it is time to flash but a sufficient charge is not available, the microcontroller will simply reset the independent flash rate counter.

Figure 8:
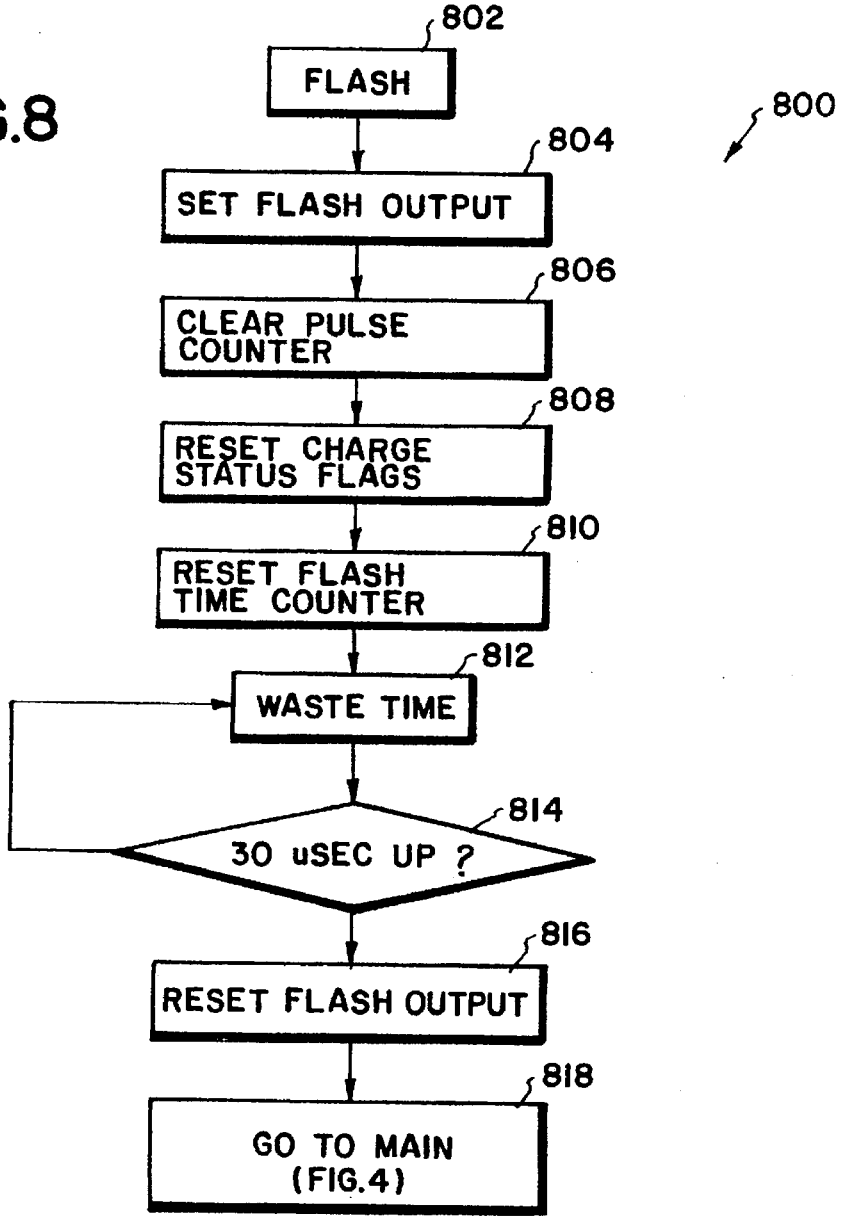
FIG. 8 is a flow diagram of the flash routine shown in FIG. 3 for flashing the strobe light of the flash circuit.

Referring to FIG. 8, a flash routine 800 for flashing the strobe light of the flash circuit is shown. The flash routine may be called by the Sync required routines 310, 312, and Sync not required routines 314, 316 described above in reference to FIG. 3. In addition, the flash routine may be called by the standby routine 320. Starting at step 802, the microcontroller sets the flash output 804, clears a pulse counter 806, resets all charge status flags, and resets the flash time counter 810. Then, after a 30 microsecond delay 812, 814, the flash output is reset 816 and operation is returned 818 to the main routine 304.

The invention having been thus described with particular reference to the preferred forms thereof, it will be obvious that various changes and modifications may be made therein without departing from the spirit and scope of the invention as defined in the appended claims.

Wherefore, we claim:

1. A synchronous strobe system of an alarm system for flashing a plurality of strobe devices in sync, the synchronous strobe system including a control panel for transmitting a synchronization signal to the strobe devices, each of the strobe devices comprising:

a strobe light;

means for detecting the synchronization signal transmitted by the control panel;

a microcontroller, responsive to detection of the synchronization signal by said detection means, for producing a strobe output signal; and means, responsive to said strobe output signal of said microcontroller, for flashing said strobe light, wherein said strobe lights of the plurality of strobe devices flash together in sync with each other.

2. The synchronous strobe system of claim 1, wherein:

said microcontroller has a first Sync mode and a second Sync mode;

said first Sync mode being operative to instruct said flashing means to flash said strobe light responsive to said detection of said synchronization signal; and said second Sync mode being operative to instruct said flashing means to flash said strobe light at an independent flash rate until said detection of said synchronization signal, said microcontroller being effective to realign said independent flash rate corresponding to said synchronization signal.

3. The synchronous strobe system of claim 2, wherein each of said strobe devices further comprises a mode circuit for indicating to said microcontroller to select between said first Sync mode and said second Sync mode.

4. The synchronous strobe system of claim 1, wherein said microcontroller provides a flash rate signal to said flashing means for indicating a particular flash rate among a plurality of possible flash rates for said strobe light, and said strobe light varies its flash rate responsive to said flash rate signal.

5. The synchronous strobe system of claim 4, wherein said plurality of possible flash rates includes a 1 Hz. flash rate and a 0.33 Hz. flash rate.

6. The synchronous strobe system of claim 1, wherein each of said strobe devices further comprises a crystal circuit for providing said microcontroller with a reference signal to flash said strobe light at an independent flash rate until said detection of said synchronization signal occurs.

7. The synchronous strobe system of claim 1, wherein each of said strobe devices further comprises a low voltage detection circuit for indicating a low voltage condition to said microcontroller, said microcontroller being effective to execute a standby operation responsive to said indication of said low voltage condition.

8. A synchronous strobe system of an alarm system comprising:

a control panel having means for generating a synchronization signal on a periodic time basis;

means for transmitting said synchronization signal from said control panel, said transmitting means being electrically connected to said control panel; and a plurality of strobe devices electrically connected to said transmitting means for receiving said synchronization signal, each of said strobe devices comprising:

means for detecting said synchronization signal transmitted along said transmitting means; and means, responsive to said detection of said synchronization signal, for flashing a strobe light;

wherein said strobe lights of said plurality of strobe devices flash together in sync with each other.

9. The synchronous strobe system of claim 8, wherein each of said strobe devices further comprises a microcontroller, responsive to detection of the synchronization signal by said detection means, for indicating to said flashing means that said synchronization signal has been detected.

10. The synchronous strobe system of claim 8, wherein:

each of said strobe devices has a first Sync mode and a second Sync mode;

said first Sync mode being operative to instruct said flashing means to flash said strobe light responsive to said detection of said synchronization signal; and said second Sync mode being operative to instruct said flashing means to flash said strobe light at an independent flash rate until said detection of said synchronization signal, said microcontroller to being effective to realign said independent flash corresponding to said synchronization signal.

11. The synchronous strobe system of claim 10, wherein each of said strobe devices further comprises a mode circuit for indicating to said microcontroller to select between said first Sync mode and said second Sync mode.

12. The synchronous strobe system of claim 8, wherein said microcontroller provides a flash rate signal to said flashing means for indicating a particular flash rate among a plurality of possible flash rates for said strobe light, and said strobe light varies its flash rate responsive to said flash rate signal.

13. The synchronous strobe system of claim 12, wherein said plurality of possible flash rates includes a 1 Hz. flash rate and a 0.33 Hz. flash rate.

14. The synchronous strobe system of claim 8, wherein each of said strobe devices further comprises a crystal circuit for providing said microcontroller with a reference signal to flash said strobe light at an independent flash rate until said detection of said synchronization signal occurs.

15. The synchronous strobe system of claim 8, wherein each of said strobe devices further comprises a low voltage detection circuit for indicating a low voltage condition and for inducing said strobe device to execute a standby operation.

* * * * *